United States Patent [19]

Kuwabara et al.

[11] 4,021,633

[45] May 3, 1977

[54] PERSISTENT CURRENT SWITCH INCLUDING ELECTRODES FORMING PARALLEL CONDUCTIVE AND SUPERCONDUCTIVE PATHS

[75] Inventors: Kooji Kuwabara; Hiroyuki Sugawara, both of Hitachi; Takao Miyashita, Mito, all of Japan

[73] Assignee: Hitachi, Ltd., Japan

[22] Filed: May 12, 1975

[21] Appl. No.: 576,372

[30] Foreign Application Priority Data

May 15, 1974 Japan ..... 49-53321

[52] U.S. Cl. ..... 200/262; 200/289; 200/144 B; 335/216

[51] Int. Cl.[2] ..... H01H 1/02

[58] Field of Search ..... 200/144 B, 262, 263, 200/266, 279, 289; 335/216

[56] References Cited

UNITED STATES PATENTS

| | | | |
|---|---|---|---|
| 2,295,338 | 9/1942 | Ely | 200/262 |
| 3,349,209 | 10/1967 | Zar | 335/216 |
| 3,440,376 | 4/1969 | Rabinowitz | 200/289 |
| 3,485,978 | 12/1969 | Grindell | 200/266 |
| 3,551,861 | 12/1970 | Boom | 200/262 |

*Primary Examiner*—Gerald P. Tolin
*Attorney, Agent, or Firm*—Craig & Antonelli

[57] ABSTRACT

A persistent current switch adapted to connect the ends of a superconducting coil together and to disconnect the ends thereof includes a vacuum casing and at least a pair of electrodes disposed in the vacuum casing in opposing relationship to each other. Each of the electrodes is provided with a highly conductive contact portion of high-purity metal having a very small resistivity at extremely low temperatures and with at least one superconducting contact portion of superconducting material in alignment with one another in the respective electrodes so that parallel current paths of the highly conductive contact portion and the superconducting contact portion may be simultaneously established when the electrodes are brought into contact with each other. The persistent current flows through the superconducting contact portion in the normal state, but the current is swiftly diverted to the highly conductive contact portion when the S-N transition takes place owing to the deterioration of the critical current value of the superconductor due to the sudden change in conduction current or the application of external magnetic field so that the rapid attenuation of the persistent current can be prevented.

8 Claims, 11 Drawing Figures

PERSISTENT CURRENT SWITCH INCLUDING ELECTRODES FORMING PARALLEL CONDUCTIVE AND SUPERCONDUCTIVE PATHS

BACKGROUND OF THE INVENTION

1. Field of the Invention

The present invention relates to a persistent current switch, especially of vacuum type in which the switching contacts are disposed in high vacuum.

2. Description of the Prior Art

It is necessary for a persistent current switch used to connect both ends of a superconducting coil to have a very small resistance in its closed state. The surfaces of the contacts of a vacuum type persistent current switch having its electrodes disposed in vacuum are free from contamination and formation of oxide film so that the contacting surfaces can be always kept clean. Therefore, the resistance $R_a$ of the vacuum type persistent current switch in its closed state is given by the following expression: $R_a = R_C + R_H$, where $R_c$ is the constriction resistance ($= \rho/2a$, $\rho$: resistivity of the material of the contacts, $a$: radius of the real contact area) and $R_H$ is the resistance of the holder. The ratio of the constriction resistance $R_c$ to the holder resistance $R_H$ is about 10 : 1 and the resistance $R_a$ can be reduced by reducing the constriction resistance $R_c$.

If the contacts of the switch are made of superconducting material, the resistivity $\rho$ of the material is almost zero and the constriction resistance $R_c$ is almost zero, too. Consequently, the resistance $R_a$ is reduced to about a tenth of its value otherwise assumed. The experiments have revealed that the contacts of copper give a resistance of 0.13 $\Omega$ while the contacts of superconducting material, having the same configuration, exhibit a resistance as small as 0.025 $\mu\Omega$. The use of the superconducting material as the contacts of the persistent current switch can make the resistance $R_a$ of the switch smaller, but the superconducting material itself causes a new problem.

The problem is with the current carrying capacity of the persistent current switch. As well known, when a current larger than a certain value (critical current) depending upon temperature and magnetic field is introduced through a superconducting material, the material is changed from its superconducting state with $\rho = 0$, to the normal conducting state having a large value of $\rho$. This phenomenon is termed the S-N transition. The resistance $R_a$ of a persistent current switch using superconducting material as its contacts is no longer equal to 0.025 $\mu\Omega$ but multiplied by a factor of $10^5$, for a current larger than the critical current. Therefore, with a persistent current switch using superconducting material as its contacts, the absolute requirement is that the switch must be operated by a current smaller than the critical one. Let the allowable maximum current for the persistent current switch be termed the current carrying capacity.

The current carrying capacity of the above mentioned persistent current switch having its resistance $R_a = 0.025\ \mu\Omega$ is 350 Ap (in the absence of external magnetic field), but this value cannot be used for a large-sized superconducting coil having several times as much exciting current.

The material for the contacts of a conventional persistent current switch is cut out of the mass of superconducting substance. Since such a material has a small degree of workability, the number of irregular density points is small and hence the critical current is not of so large a value. In general, superconducting materials have a poor thermal conductivity and if the electrodes of a persistent current switch are entirely made of superconducting material, local temperature rises will occur resulting in an undesirable lowering of critical current because the heat generated in the electrodes as a result of the shift of magnetic flux (flux jump) caused at the time of current conduction cannot be swiftly dissipated.

SUMMARY OF THE INVENTION

One object of the present invention is to provide a vacuum type persistent current switch having a stable characteristic and a very small resistance.

Another object of the present invention is to provide a vacuum type persistent current switch having a small resistance and several times as large a current conduction capacity as conventional persistent current switches.

According to the present invention, there is provided a vacuum type persistent current switch having a very small resistance and a very much improved current carrying capacity, comprising at least a pair of highly conductive electrodes made of highly pure metal and so disposed opposite each other as to be separated from each other; electrode holders for holding said electrodes; and a hermetical casing evacuated to make the interior thereof highly vacuum, said casing insulating said electrodes in their separated state from each other, wherein each of said electrodes is provided with a highly conductive contact portion made of highly pure metal which has a very small resistivity at extremely low temperatures and a superconducting contact portion made of superconducting metal so that a stable characteristic can be obtained by forming parallel current paths when said contacts are closed.

According to one embodiment of the present invention, highly pure and highly conductive metal whose resistivity at extremely low temperature is very small is used for the electrode material of the main body electrodes of the persistent current switch; at least one wire of superconducting metal material having a desired length in the direction of current flow is embedded in the electrode material of each electrode in such a manner that the end of the superconductor wire is exposed in the contacting surface so that upon closure of the electrodes the highly conductive metal part and the superconducting metal part may provide parallel current paths; and by making the length of the superconducting wire longer in the direction of current flow, the contact resistance between the highly conductive metal and the superconductive metal can be made small and moreover the heat due to the flux jump can be swiftly dissipated.

As the above mentioned superconducting material can be used niobium-titanium-yttrium alloy, niobium-titanium-zirconium alloy or other known suitable superconducting material. On the other hand, pure aluminum or pure copper with high electrical and thermal conductivity can be used as the highly conductive metal.

The embedding of the superconducting material in the high conductive metal is performed, for example, by boring the highly conductive metal, by inserting the superconducting material into the bore and by subjecting the highly conductive metal with the superconducting material inserted therein to a wire drawing process.

The electrode material having superconducting material exposed in both end surfaces thereof can be obtained by so cutting the thus fabricated superconductor-embedded, highly conductive metal as a desired length.

According to another preferred embodiment, a composite superconducting wire which is formed by embedding plural superconductin g wires in highly pure metal, may be used. In a preferable example, such a composite superconducting wire is a pure copper wire having a diameter of 0.5 to 1 mm, with 200 to 300 fine wires superconductor, each having a diameter of 25 to 50 $\mu$, embedded therein.

DESCRIPTION OF THE PREFERRED EMBODIMENTS

Figure 1:
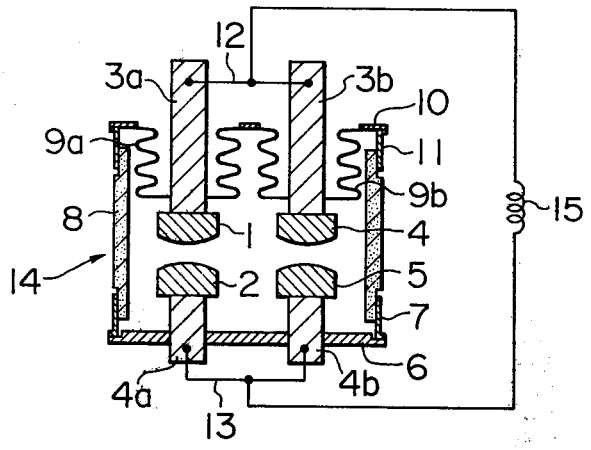
FIG. 1 is a longitudinal cross section of a persistent current switch as one embodiment of the present invention.

FIG. 1 shows an embodiment of the persistent curent switch according to the present invention. In FIG. 1, a movable electrode 1 and a fixed electrode 2 are both made of highly conductive material having a very small resistivity, e.g. 0.01 $\mu\Omega$·cm at extremely low temperatures, such as pure aluminum or pure copper and serve as normal conducting contacts. The electrodes 1 and 2 are rigidly coupled respectively to holders 3*a* and 4*a* of highly conductive metal, such as copper, and serve as a highly conductive switch element. A movable electrode 4 and a fixed electrode 5 are both made of superconducting material, such as niobium-yttrium alloy, niobium-titanium-zirconium alloy or other known suitable superconducting materials, and serve as a superconducting switch element. The electrodes 4 and 5 are rigidly coupled respectively to holders 3*b* and 4*b* of highly conductive metal, such as copper. The holders 4*a* and 4*b* are hermetically coupled to metal plate 6 fastened hermatically to a metal junctioning member 7 which is hermetically coupled to one end of a ceramic insulating cylinder 8. The holders 3*a* and 3*b* are hermetically coupled to bellows 9*a* and 9*b* which are hermetically fastened via junctioning members 10 and 11 to the other end of the insulating cylinder 8. Thus, the electrodes 1, 2, 4 and 5 are housed in an air-tight casing and the air-tight casing is evacuated to high vacuum of less than $10^{-4}$ Torr. The movable holders 3*a* and 3*b* and the fixed holders 4*a* and 4*b* are respectively connected to each other and with the terminals of a superconducting coil 15, by means of conductors 12 and 13, as shown in FIG. 1. For persistent current operation, the persistent current switch 14, as well as the superconducting coil 15, is immersed in an extremely low temperature medium (not shown) such as liquid helium. Then, the switch 14 is closed to cause persistent current to flow. If the value of the persistent current is smaller than the critical current value characteristic of the superconducting contacts consisting of the movable electrode 4 and the fixed electrode 5, all the current flows through a circuit of the movable holder 3*b*, the movable electrode 4, the fixed electrode 5 and the fixed holder 4*b*, with zero contact resistance. Consequently, the persistent current is little attenuated and the superconducting coil 15 can be stably operated for a considerably long period. Now, if the critical current value is rendered smaller than the value of the persistent current by, for example, the application of an external magnetic field, then the S-N transition takes place in the superconducting material so that the superconducting contacts having nearly zero resistance, consisting of the movable electrode 4 and the fixed electrode 5, are turned into normal conducting contacts having a relatively large resistance, e.g., several ohms. In this embodiment, however, the movable electrode 1 and the fixed electrode 2 of normal conducting metal are provided in parallel with the movable and fixed electrodes 4 and 5 of superconducting material and therefoe the therefore current is diverted to the path consisting of the movable holder 3*a*, the movable electrode 1, the fixed electrode 2 and the fixed holder 4*a*. As described above, the path has a resistance of about 0.1 $\mu\Omega$ so that sudden attenuation of the persistent current does not take place and the superconducting coil 15 can be operated without interruption. If the external disturbance is temporary, the movable and fixed electrodes 4 and 5 are restored to the superconducting state due to the cooling medium so that the persistent current resumes flowing through the superconducting contacts. In this embodiment, the normal conducting electrodes 1 and 2 and the superconducting electrodes 4 and 5 are housed in a hermetical casing, but the same result can be obtained even by placing the normal conducting electrodes and the superconducting electrodes in separate hermetical casings, respectively.

Figure 2:
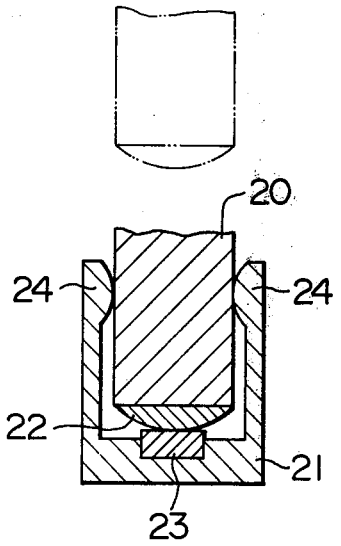
FIG. 2 is a longitudinal cross section of an electrode part of the persistent current switch as another embodiment of the present invention.

FIG. 2 shows another embodiment of the present invention, illustrating only an electrode part of the persistent current switch shown in FIG. 1. A movable electrode 22 and a fixed electrode 23 of superconducting material are provided respectively in the portions of a movable electrode 20 and a fixed electrode 21 of highly material such as high-purity copper, the electrodes 22 and 23 serving as superconducting contacts. On the other hand, a portion of the fixed electrode 21 is extended upward and provided with contactors 24 which are kept in contact with the movable electrode 20 to serve as normal conducting contacts. The contacts are opened or closed according as the movable electrode 20 is in its shift-up position (indicated by two-dot chain line) or in its shift-down position (indicated by solid line) as shown in FIG. 2. According to this embodiment, the single movable electrode 20 mechanically shifting up and down can provide parallel conduction paths of normal conducting contacts and superconducting contacts so that not only the same result as obtained by the switch shown in FIG. 1 can be obtained, but also the structure of the persistent current switch itself can be simplified.

Figure 3:
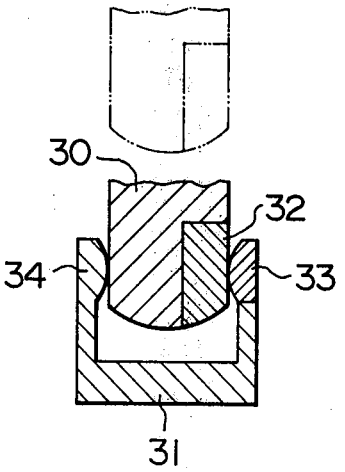
FIG. 3 is a longitudinal cross section of an electrode part of a persistent current switch as another embodiment of the present invention.

FIG. 3 shows another example of the structure of the electrodes of the switch shown in FIG. 1. In this example, a movable electrode 32 and a fixed electrode 33 of superconducting material are in sliding-contact configuration rather than in butt contact configuration, as shown in FIG. 2, the movable and fixed electrodes 32 and 33 being provided in the portions of a movable electrode 30 and a fixed electrode 31 of highly conductive metal and having the same shapes as those shown in FIG. 2. The electrodes 32 and 33 serve as superconducting contacts. The other portion of the movable electrode 30 together with a sliding contactor 34 forms normal conducting contacts. Both the superconducting and the normal conducting contacts are opened and closed as the movable contact 30 is shifted up (as indicated by two-dot chain line) or down (as indicated by solid line) as shown in FIG. 3. Moreover, the electrode structure may be in the well-known tulip contactor configuration with a plurality of contactors. This embodiment is the same in structure as that shown in FIG. 2. Namely, the parallel current conduction paths of normal conducting contacts and superconducting contacts can be established by moving the sole movable member 30. Therefore, this embodiment can produce the same result as obtained by that shown in FIG. 2.

Figure 4:
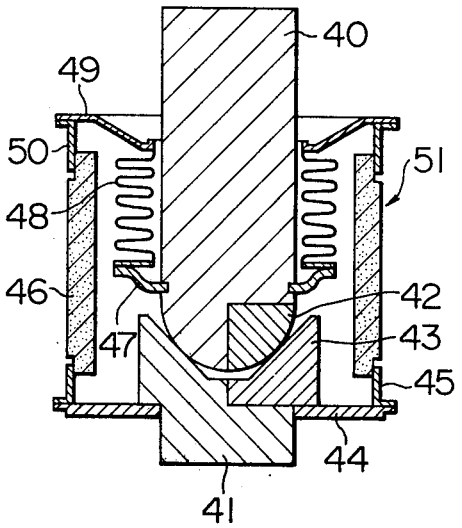
FIG. 4 is a longitudinal cross section of a persistent current switch as another embodiment of the present invention.

FIG. 4 shows another embodiment of the persistent current switch according to the present invention. In this figure, a movable electrode 40 and a fixed electrode 41 are made of a normal conducting metal, such as described above, and form normal conducting contacts. In the portions of these normal conducting electrodes 40 and 41 are provided superconducting electrodes 42 and 43 serving as superconducting contacts. The fixed electrode 41 is hermetically coupled to a metal plate 44 fastened hermetically to a metal junctioning member 45 which is air-tightly coupled to one end of an insulating cylinder 46 of ceramic material. The movable electrode 40 is hermetically coupled via a metal junctioning member 47 to bellows 48 which are hermetically coupled via metal junctioning members 49 and 50 to the other end of the insulating cylinder 46. The thus defined closed space is evacuated to high vacuum of less than $10^{-4}$ Torr and the overall switch is immersed in extremely low temperature medium such as liquid helium (not shown). With this structure, both the normal conducting and superconducting contacts are simultaneously opened or closed according as the movable electrode 40 is shifted up or down. This embodiment can provide the same result as obtained by those shown in FIGS. 2 and 3.

Figure 5:
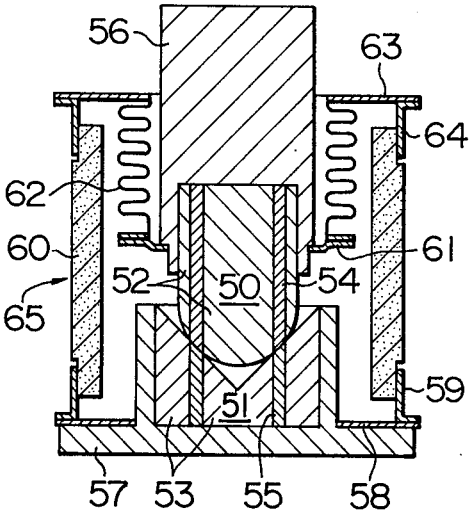
FIG. 5 is a longitudinal cross section of a persistent current switch as yet another embodiment of the present invention.

FIG. 5 shows in cross section the structure of a persistent current switch forming yet another embodiment of the present invention. In this figure, a movable electrode 50 and a fixed electrode 51 include high-purity metal portions 52 and 53, in which superconducting members 54 and 55 are embedded in the direction of current flow taking place when the electrodes are closed, with the ends of the superconducting members 54 and 55 exposed in the contacting surfaces as shown in FIG. 5. When the electrodes are closed, parallel current conduction paths consisting of a normal conducting path and a superconducting one are established. The electrodes 50 and 51 are supported respectively by holders 56 and 57 of highly conductive metal, such as copper. The holder 57 is hermetically coupled via metal junctioning members 58 and 59 to one end of an insulating cylinder 60 of caromic material and the holder 56 is hermetically coupled via a metal junctioning member 61, bellows 62 and metal junctioning members 63 and 64 to the other end of the insulating cylinder 60. The hermetical casing is evacuated to high vacuum of less than $10^{-4}$ Torr and immersed in extremely low temperature medium (not shown) such as liquid helium. With this structure, the normal conducting and superconducting contacts of the persistent current switch 65 are simultaneously closed or opened according to the movable electrode 56 is shifted down or up.

According to this embodiment, the superconducting members 54 and 55 are provided in the high-purity metals 52 and 53 of the movable and fixed electrodes 50 and 51, extending in the direction of current flow taking place when the contacts are closed, so that not only the contact resistance between the high-purity metal and the superconducting member can be made small but also the heat generated due to flux jump can be swiftly dissipated.

Figure 6:
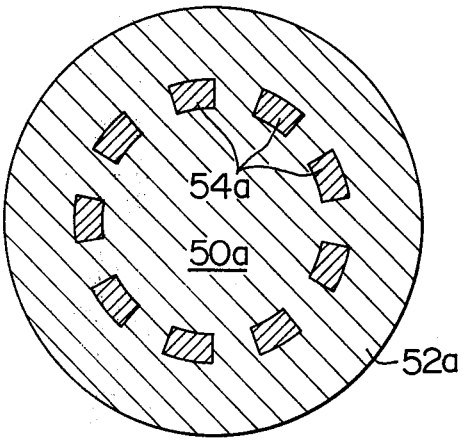
FIG. 6 is a lateral cross section of a variation of the electrode part of the persistent current switch shown in FIG. 5.

FIG. 6 shows in horizontal cross section a variation of the movable electrode 50 of the persistent current switch shown in FIG. 5. The fixed electrode 51 may be in the same cross section. As shown in FIG. 6, the superconducting members 54*a*, each having an approximately rectangular cross section, are arranged along the ring-shaped contacting surface between the movable and fixed electrodes 50 and 51 shown in FIG. 5. With these constitutions, when the contact between the movable and fixed electrodes is closed, contact between the superconducting members takes place simultaneously with contact between high-purity metal portions. This embodiment can provide the same result as obtained by that shown in FIG. 5.

Figure 7:
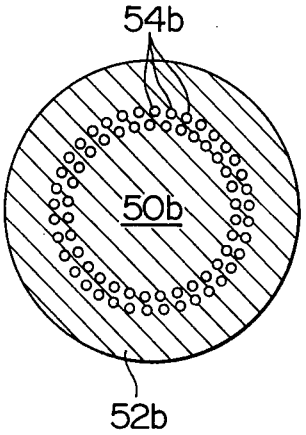
FIG. 7 is a lateral cross section of another variation of the electrode part of the persistent current switch shown in FIG. 5.

FIG. 7, like FIG. 6, shows the horizontal cross section of a variation of the movable electrode 50, in which the ends of a multiplicity of superconducting wires having a relatively small cross sectional area and embedded lengthwise in the electrode body 52*b* of highly conductive metal, appear exposed in the ring-shaped contacting surface of the movable electrode 50*b*. Both the normal contacts and the superconducting contacts are opened or closed simultaneously, just as in the case of the embodiment shown in FIG. 6.

The electrode structures shown in FIGS. 1 through 7 have the following preferable features. These features will be described with the aid of FIG. 5.

First, during the operation of the persistent current switch 65, the superconducting members 54 and 55 are cooled below the critical temperature thereof, through the movable holder 56 and the high-purity metal 52 and through the fixed holder 57 and the high-purity metal 53, by an extremely low temperature medium, such as liquid helium, so that they are in the superconducting state with their resistivity $\rho$ equal to zero. Accordingly, the constriction resistance $R_c$ which is more than 90% of the switching resistance, is reduced to zero. Moreover, the electrodes 50 and 51 are housed and actuated in the vacuum casing consisting of the bellows 62 and the ceramic cylinder 60 so that their contacting surfaces are free from contamination and that an ideal contact can be expected. Therefore, the switching resistance was found to be about 0.02 to 0.04 $\mu\Omega$, as was revealed by the inventors' experiment. This means that the resistance of the persistent current switch in its closed state can be rendered considerably small and hence that the drawback of a mechanical persistent current switch having a relatively large switching resistance can be eliminated according to the present invention.

Secondly, since the superconductors 54 and 55 are extended along the direction of current flow and infolded in the high-purity metals 52 and 53, the contact resistances between the superconductor 54 and the metal 42 and between the superconductor 55 and the metal 53 can be considerably reduced.

According to the data obtained as a result of the experiments by E. J. Lucas et al (CURRENT TRANSFER IN CONTACTS INVOLVING SUPERCONDUCTORS) on the contact resistance between superconductor and oxygen free copper, the contact resistance associated with oxygen free copper substrate having Nb-33% Zr wire, 0.01 inch diameter, embedded therein is 0.31 $\mu\Omega$, 0.27 $\mu\Omega$ and 1.05 $\mu\Omega$ respectively for the depths of embedding 1 inch, 0.5 inch and 0.25 inch. These values are measured in the absence of external magnetic field and the corresponding values are larger, i.e. 0.39 $\mu\Omega$, 0.5 $\mu\Omega$ and 1.5 $\mu\Omega$, under the influence of an external magnetic field of 50 KG.

The above mentioned values are still too large for a persistent current switch in which even a resistance of 0.01 $\mu\Omega$ causes a problem. The contact resistance can be lessened simply by increasing the area of contact between the superconductor and the oxygen free copper. For example, if the diameter of the superconductor wire is increased to 0.25 cm, the resulting increase in contact area decreases the respective resistances for embedding depths of 1 inch, 0.5 inch and 0.25 inch, to $3.1 \times 10^{-3}$ $\mu\Omega$, $2.7 \times 10^{-3}$ $\mu\Omega$ and $1.05 \times 10^{-2}$ $\mu\Omega$ (as assumed in the extended application of the abovementioned data).

As described above, the overall resistance of a persistent current switch having superconducting contacts, in its closed state is 0.02 to 0.04 $\mu\Omega$ and the contact resistance even in the case of a superconductor having a diameter of 0.25 cm and a length of contact of 0.25 inch, cannot be said to be sufficiently small.

It is known from the above data that the length of contact along the lengthwise direction of the superconductor must be equal to or larger than 0.5 inch. Namely, practical electrodes 50 and 51 for persistent current switch can be obtained by increasing the contact area and hence decreasing the contact resistances between the superconductors 54 and 55 and the high-purity metals 52 and 53 by increasing the lengths of the superconductors embedded in the high-purity metals in the lengthwise directions of the electrodes.

Thirdly, according to the present invention, the superconductors 54 and 55 are so embedded in the localized portions of the electrodes 50 and 51 as to be abutted against each other when the switch is closed, and infolded by the high-purity metals 52 and 53 having an excellent thermal conductivity so that the heat generated in the superconductors 54 and 55 due to flux jump is rapidly dissipated through the metals 52 and 53, the movable holder 56 and the fixed holder 57. Therefore, a persistent current switch which is stable against the current flowing therethrough and has a large current conduction capacity is obtained. It is needless to say that the increase in the contact area contributes to and hence is effective for, the swifter dissipation of the heat generated due to flux jump.

Fourthly, since the contacting surfaces have a ring shape, the contacting area is relatively large (compared with that in point contact) so that a persistent current switch having a large current carrying capacity can be provided. In a switch using superconducting contacts, the current carrying capacity depends upon the allowable current density through the contacting surfaces and therefore the increase in contacting area adds to the increase in current carrying capacity.

Further, according to the present invention, both the superconducting contacts and the normal conducting contacts are simultaneously opened or closed so that the current flows through the superconducting contacts when it is below the critical current of the superconductors 54 and 55 while the current greater than the critical value flows through the normal conducting contacts. Since the resistivity of the high-purity metal at extremely low temperatures is very small, the switching resistance of the normal conducting contacts for conduction current is about 0.1 $\mu\Omega$. Namely, with the switch having the above described structure, the current carrying capacity can be increased nearly to the critical value for the superconductors 54 and 55.

Next, other examples of the structure of the electrode of a persistent current switch according to the present invention will be described.

Figure 8:
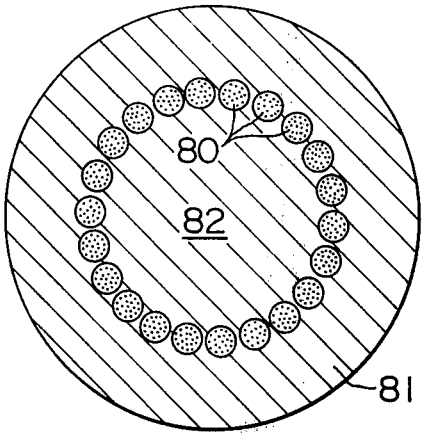
FIG. 8 is a lateral cross section illustrating a preferred example of the structure of the electrode part of the persistent current switch shown in FIG. 5.
Figure 9:
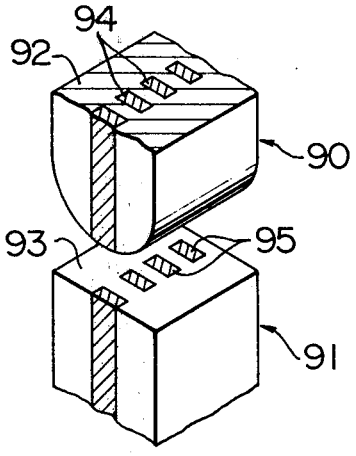
FIGS. 9 to 11 are perspective views of variations of the electrode part of the switch shown in FIG. 5.

FIG. 8 shows in horizontal cross section a variation of the electrode shown in FIGS. 6 or 7, devised from the standpoint of practice. As shown in FIG. 8, a plurality of composite multi-core superconducting wires 80 are embedded in high-purity metal 81, the composite multi-core superconducting wires 80 extending in the direction of current flow and the ends of the wires 80 appearing in the ring-shaped contacting surface, so that plural superconducting contacts and a normal conducting contact take place simultaneously. With this structure, an exact superconducting contact cannot be expected, but if the ratio of the cross sectional area of the copper and the total cross sectional area of the core superconductors, of each composite multi-core superconducting wire 80 is made equal to 1 : 1, the probability of occurrence of superconducting contact or normal conducting contact is 0.25 and the probability of occurrence of both superconducting and normal conducting contacts is 0.5. This means that the switching resistance in this case can be rendered below half of that of normal conducting contacts alone. Moreover, with the high-purity metal serving as a normal conducting contact, the current can be increased very nearly to the critical value for the superconductors as in the case of the embodiments shown in FIGS. 6 and 7. In the preceding embodiments, the contacting surfaces have a ring- or stripe-shaped configuration, but the present invention can also be realized in the case where the contacting surface of the fixed electrode 91 is made flat while the opposing movable electrode 90 is furnished with a contacting surface in the shape of a rounded wedge, as shown in FIG. 9. Here, a plurality of superconductors 94 and 95 are embedded in high-purity metals 92 and 93 forming the movable and the fixed electrodes 90 and 91 and both the superconducting contacts and the normal conducting contacts are simultaneously opened and closed when the electrodes 90 and 91 are separated from and abutted against each other.

Figure 10:
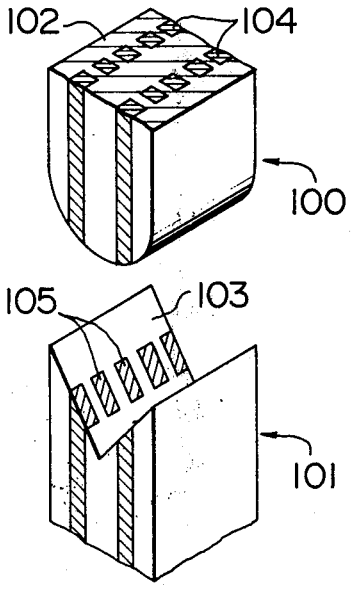

FIG. 10 shows in perspective view another embodiment of the electrode structure, in which a movable electrode 100 and a fixed electrode 101 are in the self-centering configuration with rounderd wedge and V-shaped groove. In this case, a plurality of superconductors 104 and 105 are embedded in two rows respectively in high-purity metals 102 and 103 serving as movable and fixed electrodes 100 and 101 so that both the superconductors 104 and 105 and the high-purity metals 102 and 103 are simultaneously brought into contact.

Figure 11:
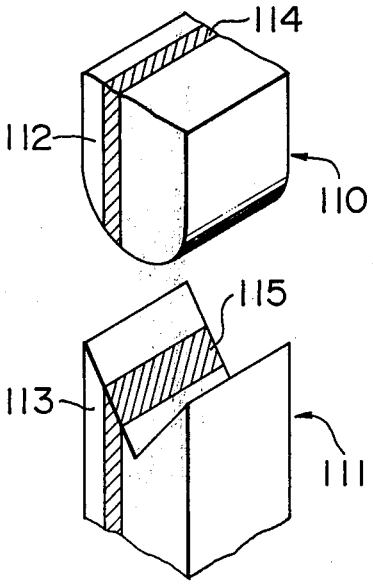

FIG. 11 shows in perspective view yet another embodiment of the electrode structure, in which a movable electrode 110 and a fixed electrode 111 are also in the self-centering configuration with rounded wedge and V-shaped groove. The only a difference in structure from FIG. 10 is the plate-shaped superconductors 114 and 115 embedded respectively in high-purity metals 112 and 113 serving as the movable and the fixed electrodes 110 and 111. These electrodes 110 and 111 are actuated and function just like those shown in FIG. 10.

As described hitherto, according to the present invention, high-purity, highly conductive metal is used as the material of the contact electrodes of a persistent current switch and at least one superconductor is embedded in each of the electrodes, the superconductor having a desired length along the direction of current flow and extending to have its end exposed in the contacting surface, so that the parallel current paths of the high-purity metal contacts and the superconductor contacts are simultaneously established upon closure of the switch. Consequently, the area of contact between the high-purity metal and the superconductor can be increased and hence the current carrying capacity can be increased so that a large capacity persistent current switch can be provided.

We claim:

1. A persistent current switch comprising at least one pair of highly conductive electrodes made of a high-purity metal and disposed opposite to each other so as to be movable into and out of contact with one another, electrode holder means for supporting said electrodes, and air-tight casing means evacuated to a high vaccum for enclosing said electrodes and supporting said electrode holder means with said electrodes in insulated relationship with each other in their separated condition, wherein the improvement comprises the fact that each of said electrodes is provided with a highly conductive contact portion of a high-purity metal having a very small resistivity at extremely low temperatures and with a superconducting contact portion of a superconducting material so that parallel current paths formed by said highly conductive contact portions and said superconducting contact portions on the respective electrodes may be simultaneously established when said electrodes are brought into contact with each other.

2. A persistent current switch as claimed in claim 1, wherein said superconducting contact portions are embedded in said highly conductive contact portions so as to have their ends exposed in the contacting surfaces of said highly conductive contact portion.

3. A persistent current switch as claimed in claim 1, wherein one of said pair of electrodes has a highly conductive contact portion and a superconducting contact portion separated from each other while the other electrode has a highly conductive contact portion of a high-purity metal having a very small resistivity at extremely low temperatures and a superconducting contact portion made of a superconductor and embedded in said high-purity metal in such a manner that one end of said superconducting contact portion is exposed in the contacting surface of said other electrode.

4. A persistent current switch as claimed in claim 1, wherein each of said electrodes has a highly conductive contact portion of a high-purity metal having a very small resistivity at extremely low temperatures and at least one portion of superconducting material embedded in said high-purity metal along the direction of current flowing when said electrodes are brought into contact, with one end of said portion of superconducting material being exposed in the contacting surface of said highly conductive contact portion.

5. A persistent current switch as claimed in claim 4, wherein said portion of superconducting material is so embedded in said high-purity metal as to extend up to both ends of said high-purity metal portion.

6. A persistent current switch comprising at least one pair of highly conductive electrodes made of a high-purity metal and disposed opposite to each other so as to be movable into and out of contact, electrode holder means for supporting said electrodes and hermetic casing means evacuated to a high vacuum for enclosing said electrodes and supporting said electrode holder means with said electrodes in insulated relationship with each other in at least their separated state, each electrode including a composite multi-core super-structure consisting of a high-purity, highly conductive metal substrate and a plurality of very fine superconducting wires embedded in said metal substrate in the direction of current flowing when said switch is closed and said electrodes are in contact with each other, said superconducting wires having their ends exposed in the contacting surfaces of said metal substrate.

7. A persistent current switch as claimed in claim 6, wherein each of said composite multi-core super-structures has said superconducting wires extending to both ends of said highly conductive metal substrate.

8. A persistent current switch comprising at least one pair of highly conductive electrodes made of a high-purity metal having a very low resistivity at extremely low temperatures and disposed opposite to each other so as to be movable into and out of contact with one another, at least one pair of superconducting electrodes made of superconducting material and disposed opposite to each other so as to be movable into and out of contact with one another, holder means for supporting said electrodes for simultaneous switching action, and air-tight casing means evacuated to a high vacuum for enclosing said electrodes and supporting said electrode holder means with said electrodes in each pair in insulated relationship with each other in their separated condition, whereby parallel current paths formed by said pairs of electrodes may be simultanteously established when said electrodes are brought into contact with each other by said simultaneous switching action.

* * * * *